United States Patent [19]

Iyama et al.

[11] 4,389,044

[45] Jun. 21, 1983

[54] MECHANICAL PUNCHING APPARATUS FOR COPPER SMELTING CONVERTER

[75] Inventors: Yukio Iyama; Masao Fujita; Nobuhiro Higashiiriki, all of Oita, Japan

[73] Assignee: Nippon Mining Co., Ltd., Tokyo, Japan

[21] Appl. No.: 282,829

[22] Filed: Jul. 13, 1981

[30] Foreign Application Priority Data

Sep. 8, 1980 [JP] Japan ..... 55-123522

[51] Int. Cl.[3] ..... C21C 5/46

[52] U.S. Cl. ..... 266/271; 266/45

[58] Field of Search ..... 266/44, 45, 47, 271, 266/136, 135, 273; 74/477, 519, 520, 521, 522.5; 248/421

[56] References Cited

U.S. PATENT DOCUMENTS 3,295,800 1/1967 Quarnström et al. ..... 248/421 X
3,314,671 4/1967 Heino et al. ..... 266/271
4,037,828 7/1977 Terada et al. ..... 266/271
4,303,229 12/1981 Iyama et al. ..... 266/271 X

*Primary Examiner*—L. Dewayne Rutledge
*Assistant Examiner*—David A. Hey
*Attorney, Agent, or Firm*—Sughrue, Mion, Zinn, Macpeak and Seas

[57] ABSTRACT

A mechanical punching apparatus for punching tuyeres in which the position of punching rods is varied in a one action in correspondence to movement of the tuyere and in which the mechanical puncher, a carriage and a puncher tilting device are readily accessible for overhaul and maintenance. A mechanical puncher including punching rods assemblies is mounted on a carriage which moves on rails along the longitudinal direction of a converter. A link structure is arranged between the puncher and the carriage for tilting and moving the puncher with the movement being restricted along a predetermined locus having a center at the center of rotation of the converter. The link includes first and second sets of levers disposed between the carriage and puncher with a coupling rod pivotally coupled between levers.

5 Claims, 8 Drawing Figures

MECHANICAL PUNCHING APPARATUS FOR COPPER SMELTING CONVERTER

BACKGROUND OF THE INVENTION

The present invention relates generally to mechanical punching apparatuses for copper smelting converters. More particularly the invention relates to a mechanical punching apparatus which can accurately and effectively punch the tuyere of a converter whose position changes with the rotating motion of the converter.

A matte containing 50 to 60% copper which has been smelting in a copper smelting process is converted into blister copper containing about 98% copper in a converting process. The converter used in the converting process is called a Pierce-Smith Type converter which is substantially cylindrical and is disposed so that its longitudinal axis is horizontal. The converter has tuyeres on the lower part of its side wall. More specifically, a plurality of tuyeres are arranged in a line parallel to the longitudinal axis of the converter. Usually, the diameter of each tuyere is about 4 to 5 cm, and about fifty tuyeres are provided at interval of about 15 cm. Compressed air under a pressure of about 1.3 kg/cm$^2$ is supplied through the tuyeres directly to the molten matte in the converter for causing an oxidation reaction of the matte. Accordingly, in the converting process the molten matte is adiabatically cooled by the blowing air at the ends of the tuyeres, as a result of which the matte is liable to solidify and become encrusted at the ends of the tuyeres. Alternatively, slag formed in the process, which may be a composite oxide containing FeO, $SiO_2$, $Fe_3O_4$, etc., is liable to solidify and become encrusted at the ends of the tuyeres. If such solidified encrustations form, which tend to clog the tuyeres, the compressed air cannot be supplied in sufficient quantities to the converter. In such an event, it is necessary to insert punching rods into the encrusted tuyeres to clear the tuyeres.

On the other hand, as the oxidation reaction advances in the converter and accordingly the level of the molten matte is decreased in the converter, it is necessary to rotate the converter to change the position of the tuyeres so that the compressed air is supplied into the deeper portion of the molten matte in the converter so that the oxidation reaction can be completely carried out in the converter.

As the converter is rotated, the horizontal direction, the vertical direction and the inclination angle of each tuyere are changed. Accordingly, it is necessary to move the mechanical punching apparatus as the position of the tuyere is changed. A conventional mechanical punching apparatus, for instance, as disclosed in Japanese Published Patent Application No. 6684/1971, has three separate mechanisms for regulating the horizontal direction, the vertical direction and the inclination angle, respectively. The conventional mechanical punching apparatus is positioned by operating each of the three mechanisms whenever the converter is rotated. This operation is troublesome and requires particular skill. Moreover, a mechanical punching apparatus exerts great impact when punch the tuyeres. Therefore, the apparatus itself and the punching rod have a tendency to wear. Accordingly, it is necessary to inspect and repair them. However, since the conventional mechanical punching apparatus has an intricate construction, its overhaul and maintenance are considerably difficult.

SUMMARY OF THE INVENTION

A primary object of the invention is to provide a mechanical punching apparatus for a converter tuyere which can set the position of the punching rod in one action in correspondence to variations in the horizontal direction, vertical direction and inclination angle of a converter tuyere and which thereof attains operability.

Another object of the invention is to provide a mechanical punching apparatus for a converter tuyere which is composed of segregated structures, namely, a mechanical puncher, a carriage and puncher tilting means, so that these structural units are readily accessible and the overhaul and maintenance thereof can be readily achieved.

The invention provides a mechanical punching apparatus overcoming these drawbacks, which includes a mechanical puncher with a punching rod for punching the tuyeres of a converter, a carriage supporting the puncher and adapted to transport the puncher in the longitudinal direction of the converter, and puncher tilting means disposed between the mechanical puncher and the carriage for tilting the mechanical puncher. This arrangement eliminates all of the above-described difficulties accompanying a conventional mechanical punching apparatus.

DESCRIPTION OF THE PREFERRED EMBODIMENTS

A mechanical punching apparatus according to the invention will be described with reference to the accompanying drawings.

Figure 1:
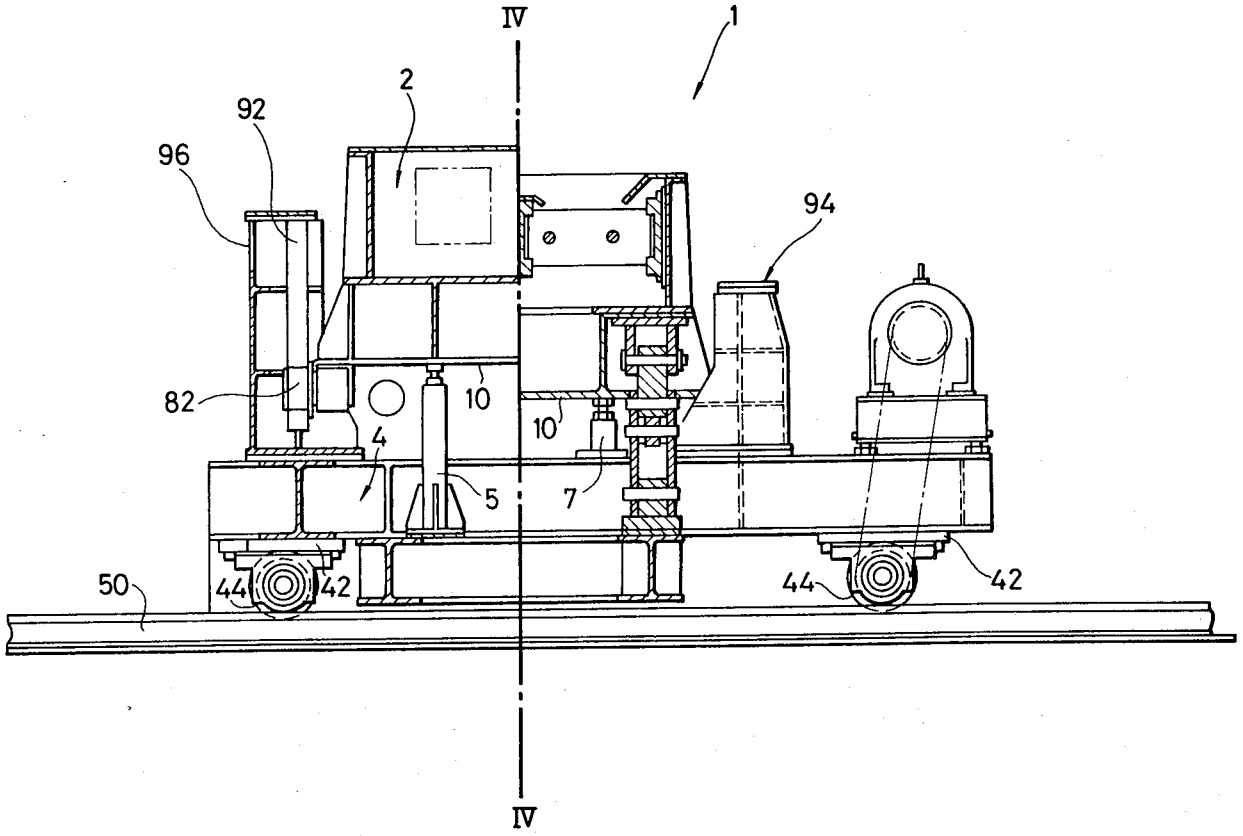
FIG. 1 is a front view, partly as a sectional view, showing a mechanical punching apparatus according to the invention, the sectional view being taken along a line II—II in FIG. 2.
Figure 2:
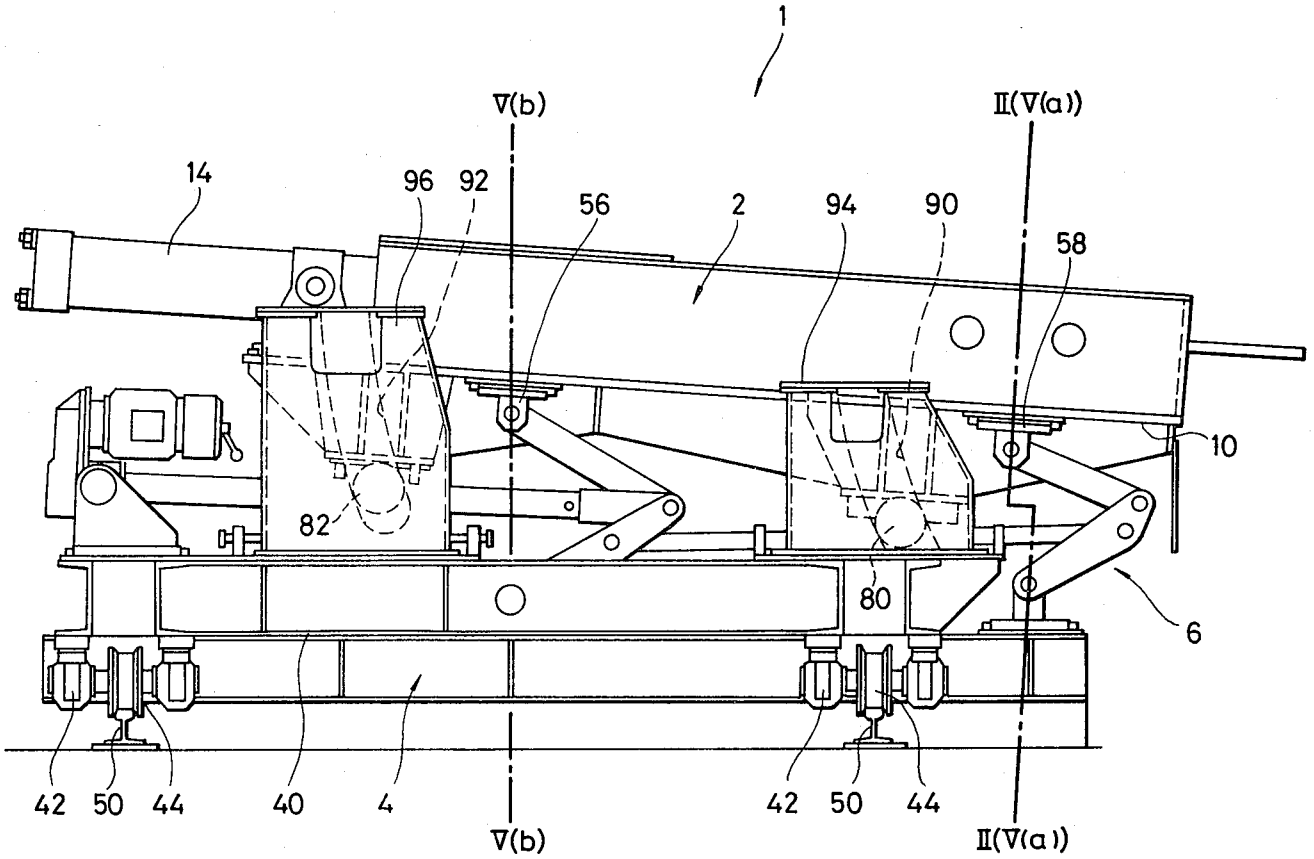
FIG. 2 is a right side view of the mechanical punching apparatus shown in FIG. 1.
Figure 3:
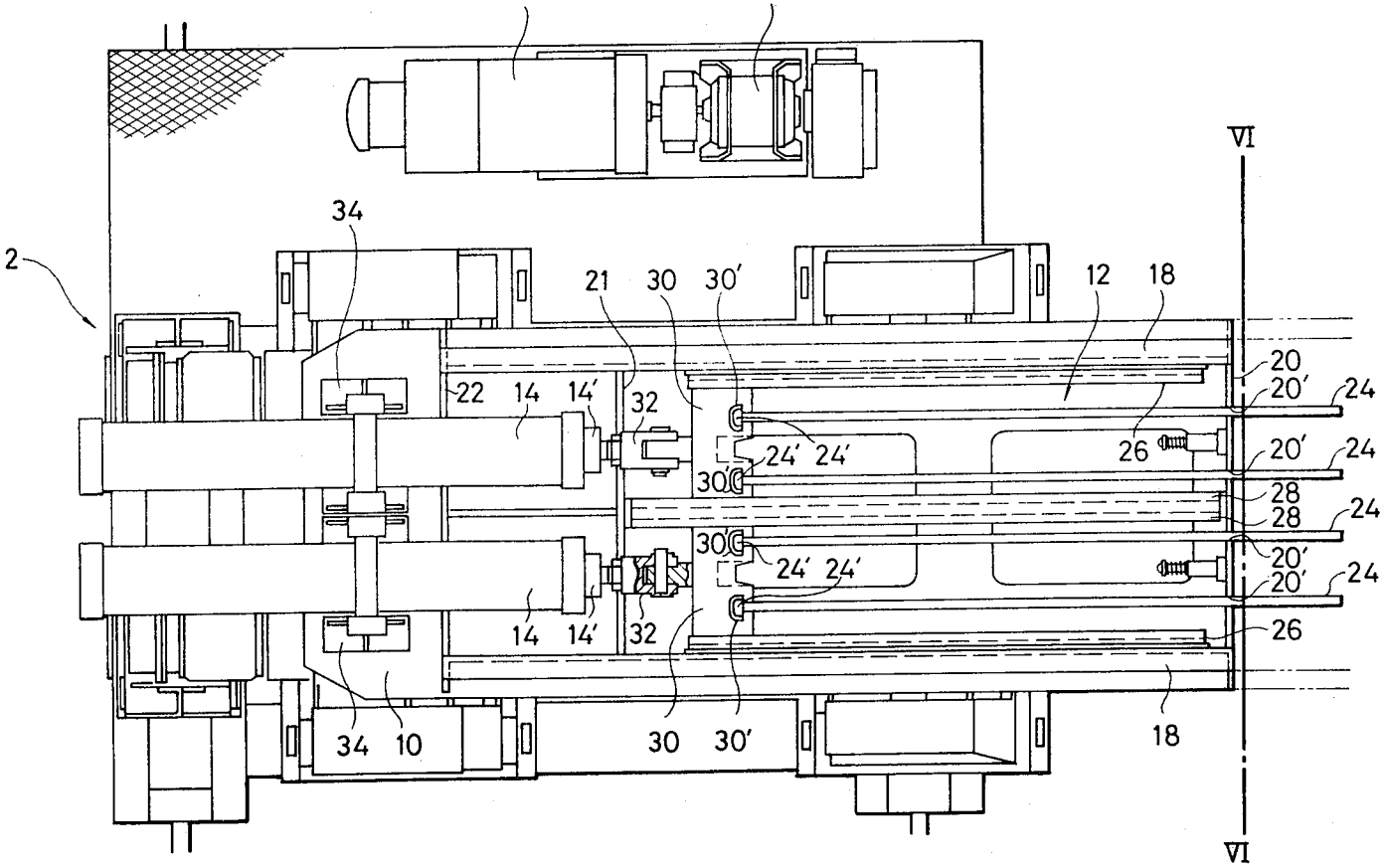
FIG. 3 is a plan view of the mechanical punching apparatus shown in FIG. 1.

As shown in the accompanying drawings, first with reference to FIGS. 1 and 2, a preferred embodiment of a mechanical punching apparatus according to the invention includes a mechanical puncher 2, a carriage 4 for supporting the puncher 2 and transporting it in the longitudinal direction of a cylindrically shaped converter 100 (FIG. 8), and a tilting device 6 disposed between the puncher 2 and the carriage 4 for tilting the puncher 2.

The mechanical puncher 2 may be a known type. Therefore, it will be only briefly described with reference to FIGS. 1 through 4. The puncher 2 includes a base stand 10, a punching rod assembly 12 slidably supported on the base stand 10, and air cylinders 14 mounted on the base stand for driving the punching rod assembly 12. The base stand 10 is rigidly formed with a bottom plate 16, two side plates 18 being integral with the bottom plate 16, and partition plates 20, 21 and 22 extending between the side plates 18. In this embodiment of the invention, a pair of punching rod assemblies 12 are provided with each punching rod assembly 12 having two punching rods 24. The punching rod assembly 12 is provided with a U-shaped guide 26 mounted on the side plate, a U-shaped guide 28 extending over the partition plates 20, 21 and 22 and secured to the partition plates 20 and 21, and a punching rod holding block 30 which is slidably engaged with the U-shaped guide grooves of the guides 26 and 28.

Each punching rod 24 is mounted by inserting its head 24' in a T-shaped groove 30' which is formed in one end portion of the punching rod holding block 30. The other end portion of the punching rod 24, opposite to the head 24', and which is to be pushed into a conveter tuyere, is fitted in an elongated groove 20' which is formed in the partition plate 20. Thus, the partition plate 20 serves as a guide for the punching rod 24.

As is apparent from the above description, each punching rod 24 can be secured to the respective punching rod assembly 12 merely by inserting the head 24' and the rod body respectively into the T-shaped groove 30' and the elongated groove 20'. Moreover, the punching rod 24 cab be removed from the punching rod assembly 12 merely by lifting it.

Each air cylinder 14 extends through the rear partition plate 22 and the middle partition plate 21. The piston 14' of the air cylinder 14 is connected through a coupling 32 to the other end portion of the punching rod holding block 30. The air cylinders 14 are held by mounting members 34 at the rear end of the base stand 10.

The mechanical puncher 2 is constructed as described above. With this construction, the punching rods 24 are moved to and from the converter tuyere as the pistons of the air cylinders 14 reciprocate. In the preferred embodiment described, a pair of punching rod assemblies 12 are provided, and each punching rod assembly 12 is driven by its own air cylinder 14. That is, the puncher 2 can simultaneously operate four punching rods 24.

Figure 4:
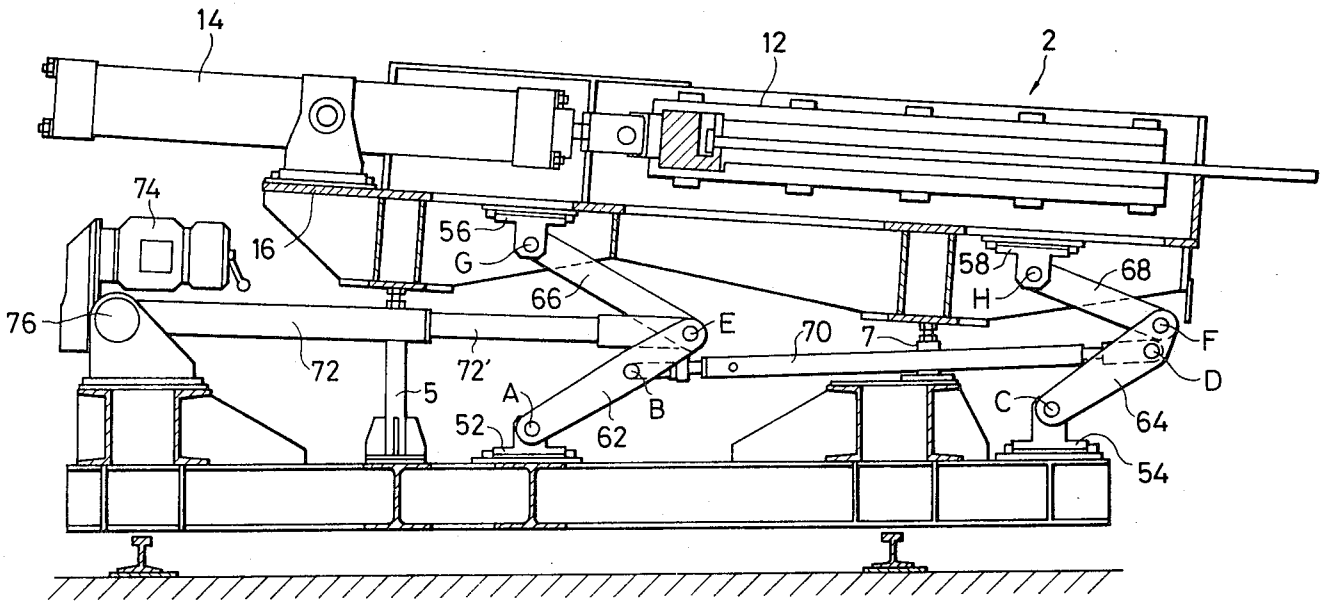
FIG. 4 is a sectional view taken along a line IV—IV in FIG. 1.

The carriage 4 bearing the mechanical puncher is provided with a rigid chassis 40 and wheels 44 which are mounted on the chassis 40 through axle mounts 42 so that an electric motor 46 and a reduction gear 48 (FIG. 3) mounted on the chassis 40 can run the carriage 4 on rails 50 which are laid in the longitudinal direction of the converter 100. As is best shown in FIGS. 1 and 4, supporting posts 5 and 7 are provided at suitable positions on the chassis 40 so as to hold the puncher 2 when the puncher 2 is lowered to its lower level limit or when the puncher tilting device 6 (described below) is removed or repaired.

The puncher tilting device 6 is provided between the machanical puncher 2 and the carriage 4 to freely tilt the puncher 2 with respect to the carriage 4. As is best illustrated in FIG. 4, the puncher tilting device 6 has a link mechanism composed of levers 62, 64, 66 and 68 and a coupling rod 70.

The link mechanism will be described in more detail. First ends of the levers 62 and 64 are pivotally secured to the pivotal points A and C of pivotal mounting members 52 and 54, respectively, which are positioned apart from each other on the chassis 40. First ends of the levers 66 and 68 are pivotally secured to the pivotal points G and H of pivotal mounting members 56 and 58, respectively, which are positioned apart from each other on the bottom plate 16 of the mechanical puncher 2. The other ends of the levers 66 and 68 are pivotally secured to the other ends of the lever 62 and 64 at the pivotal points E and F, respectively. The levers 62 and 64 are coupled to each other through the coupling rod 70 at the pivotal points B and D which are located respectively between the pivotal points A and E and between the pivotal points C and F.

The geometrical dimensions of the link mechanism are: $\overline{AB}=\overline{CD}$, $\overline{AC}=\overline{BD}$, $\overline{AE}>CF$, and $\overline{EG}>\overline{FH}$. Accordingly, a parallel motion mechanism is formed by the lever 62, the coupling rod 70, the lever 64 and the chassis 40, i.e., by the links $\overline{AB}$, $\overline{BD}$, $\overline{DC}$ and $\overline{CA}$. Thus, the pivotal points E and F can synchronously swing around the pivotal points A and C, respectively.

The levers 62 and 64 are swung by a driving means comprising a drive source 74, a mounting member 76, a power cylinder 72 and a piston 72'. The drive source 74 is mounted on a mounting member 76 on the chassis 40 and the power cylinder 72 is mounted pivotally on the mounting member. The power cylinder is connected to the drive source and the piston 72' is coupled to the pivotal point E of the lever 62. The inner surface of the power cylinder 72 is threaded. The threaded inner surface is engaged with a male thread in the outer surface of the piston 72' so that the piston 72' moves in and out of the power cylinder 72 through the threads. This provides a braking effect to prevent vibration which may occur in a punching operation.

Figure 7:
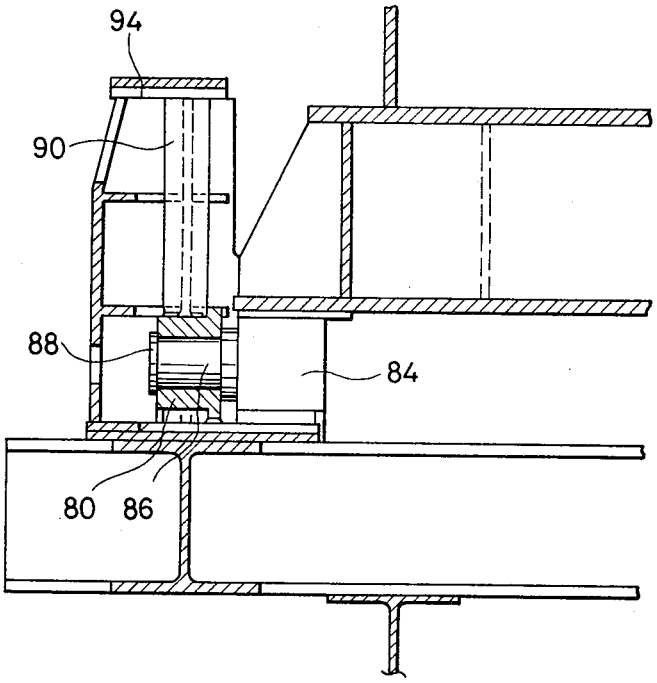
FIG. 7 is a sectional view showing the relation between the guide members and the follower of the mechanical punching apparatus.
Figure 8:
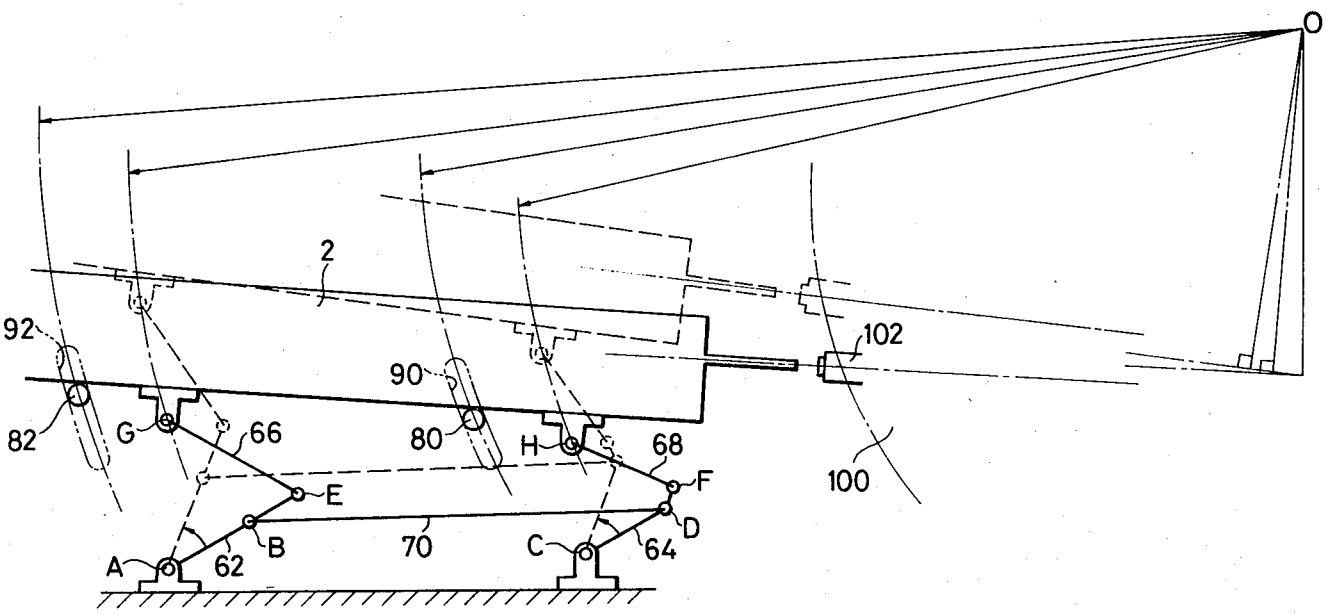
FIG. 8 is a schematic diagram for a description of the link mechanism of the mechanical punching apparatus.

As is best shown in FIGS. 2 and 7, the mechanical puncher 2 is provided with followers 80 and 82 which extend outwardly of the sides thereof. The follower 80 is disposed adjacent to the pivotal mounting member 58 in the front part of the puncher 2 while the follower 82 is disposed adjacent to the pivotal mounting member 56 in the rear part of the puncher 2. The follower 80 is rotatably mounted on the shaft 86 of follower mounting member 84 which is fixedly secured to the lower side part of the bottom plate 16 of the puncher 2. Axial play of the follower 80 is prevented by a retaining ring 88. Similarly, the follower 80 is rotatably coupled to the bottom plate 16 of the puncher 2. Guide members 94 and 96 are mounted on the chassis of the carriage 4. The guide members 94 and 96 have curved grooves 90 and 92 for receiving and guiding the followers 80 and 82, respectively. As shown in FIG. 8, the curved grooves 90 and 92 are formed along arcs having as centers the center of rotation of the conveter 100. For the curved grooves, the same effect can also be obtained by providing the guide members on the mechanical puncher side and providing the followers on the chassis of the carriage.

Figure 5:
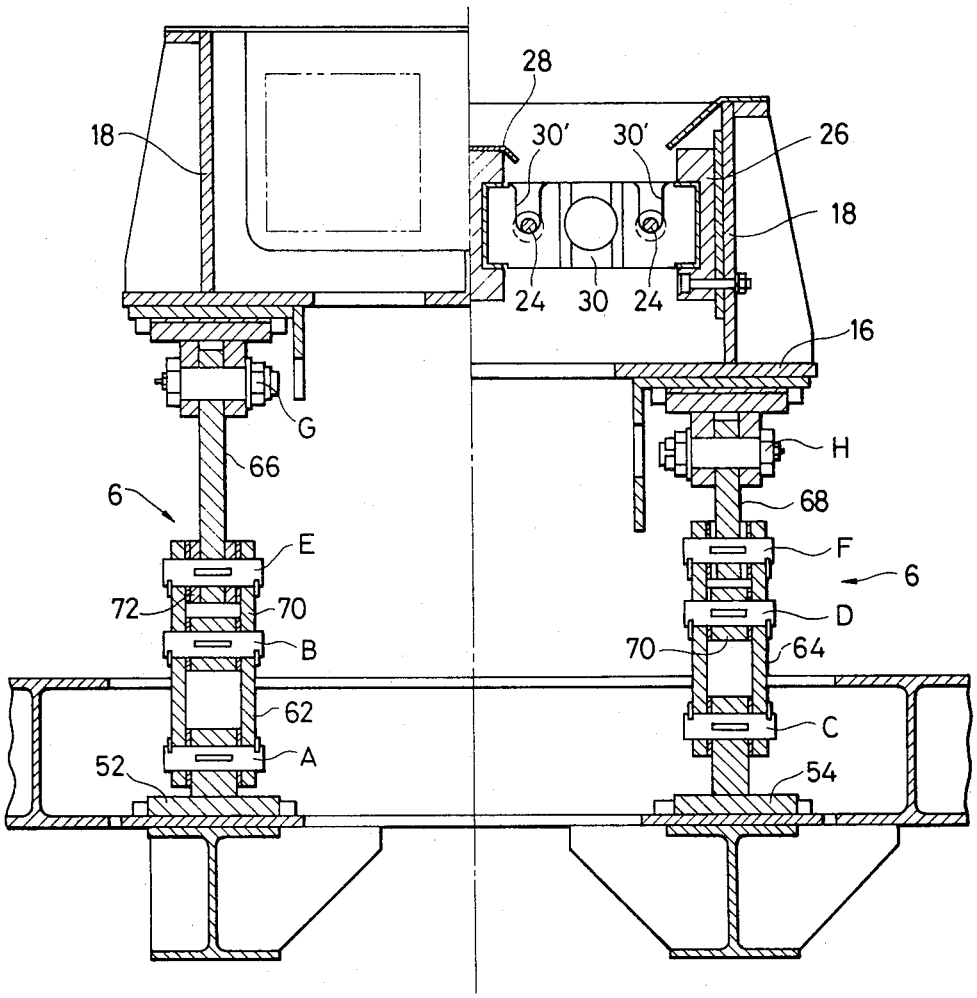
FIG. 5 is an elevation view, with right and left halves taken respectively along lines V(*a*)—V(*a*) and V(*b*)—V(*b*) in FIG. 2.
Figure 6:
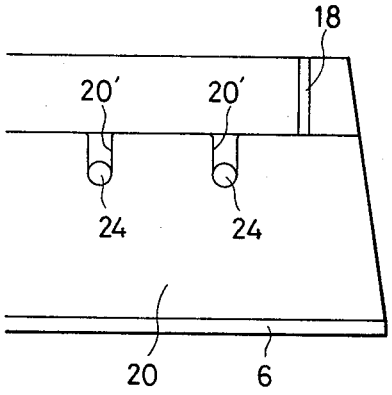
FIG. 6 is a partial sectional view taken along a line VI—VI in FIG. 3.

It should be noted that, as shown in FIG. 5, one pair of puncher tilting devices 6 described above are provided symmetrically on both sides of the mechanical punching apparatus.

Referring to FIGS. 4 and 8, as the piston 72' is operated by the drive mechanism turning the lever 62 counterclockwise around the pivotal point A, the lever 64 is then turned around the pivotal point C through the coupling rod 70. At the same time, the levers 62 and 64 push up the levers 66 and 68, respectively, as a result of which the levers 66 and 68 move the mechanical puncher 2 upwardly. In this operation, the motion of the mechanical puncher is limited by the followers and the curved grooves because the followers 80 and 82 are engaged with the curved grooves 90 and 92 of the guide members 94 and 96, respectively. Accordingly, the mechanical puncher 2 is tilted around the center $\overline{0}$ of rotation of the converter 100, and therefore the relative position of the punching rod 24 of the puncher 2 and the converter tuyere 102 is unchanged.

As is apparent from the above description, the puncher tilting devices 6 can displace the puncher 2 merely by operating the pistons of the drive mechanism so that the puncher 2 is directed to the converter tuyere 102 at all times.

In the mechanical punching apparatus according to the invention constructed as described above, the punching rods are maintained in the direction of the converter tuyere merely by operating the power cylinder. Therefore, the apparatus is considerably high in operability and in advantageous in that the operating units are individually mounted and readily accessible and hence their maintenance and repair can be achieved considerably efficiently.

What is claimed is:

1. A mechanical punching apparatus comprising:

a mechanical puncher with a punching rod adapted for punching a converter tuyere;

a carriage supporting said mechanical puncher, said carriage being adapted to move said mechanical puncher in a longitudinal direction of a converter;

link means arranged between said mechanical puncher and said carriage for tilting said mechanical puncher;

motion regulating means for causing, in cooperation with said link means, motion of said mechanical puncher effected by said link means to be along a predetermined locus having a center at a center of rotation of said converter, said link means comprising: first and second levers having first ends spaced apart from each other and pivotally secured to said carriage; third and fourth levers having first ends spaced apart from each other and pivotally secured to said mechanical puncher and second ends pivotally secured to second ends of said first and second levers; a coupling rod coupled pivotally between said first and second levers; and drive means provided on said carriage for operating said link means, said drive means comprising a generally horizontally oriented piston coupled to said link means, lengths of predetermined ones of said first through fourth levers being different from one another and being such that operation of said drive means causes said mechanical puncher to be moved along said predetermined locus having as a center a center of rotation of said converter.

2. The apparatus as claimed in claim 1 wherein said motion regulating means comprises: followers provided respectively at front and rear parts of said mechanical puncher; and guide means provided on said carriage, said guide means having arcuate grooves which receive respective ones of said followers, said arcuate grooves being formed along arcs having as center said center of rotation of said converter.

3. The apparatus as claimed in claim 1 wherein said first ends of said first and second levers are pivotally secured to said carriage at points A and C, respectively, said first ends of said third and fourth levers are pivotally secured to said mechanical puncher at points G and H, respectively, said second ends of said first and second levers are pivotally secured to said second ends of said third and fourth levers at points E and F, respectively, and said coupling rod being pivotally coupled to said first lever at point B and pivotally coupled to said second lever at point D, wherein, $AB=CD$, $AC=BD$, $AE>CF$, and $EG>FH$.

4. The apparatus as claimed in claim 1 wherein said drive means comprises a drive source, a mounting member, a power cylinder and a piston; said mounting member being fixed to said carriage and said drive source being mounted on said mounting member, and a power cylinder operatively coupled to said drive source, and said piston being moved in and out of said power cylinder upon operation of said drive source, an end of said piston being coupled to said second ends of said first and third levers.

5. The apparatus as claimed in claim 1 wherein said mechanical puncher comprises first and second air cylinders and first and second punching rod assemblies coupled to operating pistons of said first and second air cylinders, respectively, each of said punching rod assemblies comprising first and second punching rods.

* * * * *